United States Patent [19]

Beekenkamp

[11] Patent Number: 4,865,311

[45] Date of Patent: Sep. 12, 1989

[54] PLAYGROUND SLIDE CONSTRUCTION

[75] Inventor: Gerald Beekenkamp, Paris, Canada

[73] Assignee: Paris Slides Inc., Paris, Canada

[21] Appl. No.: 303,124

[22] Filed: Jan. 30, 1989

[51] Int. Cl.[4] ..... A63G 21/10

[52] U.S. Cl. ..... 272/56.5 R; 104/56; 104/69; 104/70; 209/459; 209/508; 193/12; 182/48; 52/187

[58] Field of Search ..... 272/1 R, 1 B, 56.5 R, 272/56.5 SS; 193/12, 13; 104/69–73, 56, 57, 63, 64, 67; 182/48; 209/455, 459, 485, 508, 484; 52/182–191

[56] References Cited

U.S. PATENT DOCUMENTS

| | | | |
|---|---|---|---|
| 506,238 | 10/1893 | Kirker | 52/187 |
| 750,998 | 2/1904 | Ohnstrand | 52/187 |
| 803,119 | 10/1905 | Logan | 272/56.5 R |
| 1,726,133 | 8/1929 | Wilson | 52/187 |
| 3,083,015 | 3/1963 | Barenholtz et al. | 272/56.5 R |
| 3,755,878 | 9/1973 | Henning | 272/56.5 R X |
| 4,527,367 | 7/1985 | Morellini | 52/187 |
| 4,660,335 | 4/1987 | Scholler | 52/187 |
| 4,795,553 | 1/1989 | Giffard | 209/459 |
| 4,811,943 | 3/1989 | Ahrens | 272/56.5 R |

FOREIGN PATENT DOCUMENTS

| | | | |
|---|---|---|---|
| 2025402 | 12/1971 | Fed. Rep. of Germany | 52/187 |
| 7308231 | 12/1974 | Netherlands | 52/187 |

*Primary Examiner*—Richard E. Chilcot, Jr.
*Attorney, Agent, or Firm*—Shoemaker and Mattare, Ltd.

[57] ABSTRACT

A playground slide includes a hollow vertical column consisting of substantially identical hollow hubs which register with each other to define the column. The topmost and lowermost hubs are urged toward each other by a resilient device, anchored to a base. The device is typically a spring, running internally of the vertical column. This compresses the vertical column, ensures stiffness, and allows for expansion and contraction. A helical slideway encircles the column, consisting of slide segments that are fastened to each other and to the various hubs.

9 Claims, 3 Drawing Sheets

PLAYGROUND SLIDE CONSTRUCTION

This invention relates generally to slides of the kind typically seen in playgrounds and parks. More particularly, this invention relates to the kind of slide in which the slide surface winds helically around a central post or pillar Such slides are sometimes called "spiral slides".

BACKGROUND OF THIS INVENTION

Playground slides with helical slideways are well known. The typical conventional construction of such a slide incorporates a plurality of segments, each segment including a hollow, cylindrical hub portion integral with a slideway portion. When the slideway portions are connected sequentially, they define the helical slide. The hollow cylindrical hub portions are adapted to receive an internal metal pipe or shaft which, at its bottom end, is sunk into a concrete anchor underground. The central metallic shaft provides rigidity and support for the entire slide. The conventional slide of this kind also incorporates a ladder with handrails, adapted to allow the user to climb to the upper end of the helical slideway.

While the conventional construction just described is quite satisfactory in terms of use, safety and durability, a disadvantage arises when the components for a playground slide of this kind are to be shipped over long distances to the end customer. Specifically, the various segments do not "nest" easily, and in addition there is the packaging problem created by the very long central shaft.

There is a need for a revised design which, when packaged for shipping, will occupy a smaller volume than that occupied by the conventional slide construction described above. Ideally, the various segments should nest efficiently, and, if possible, the central shaft should be eliminated.

GENERAL DESCRIPTION OF THIS INVENTION

Accordingly, it is an object of one aspect of this invention to provide a novel construction for a helical slide, which does not require the central shaft for stiffening and support purposes, and which is such as to permit more efficient nesting and a reduced volume required for shipping purposes.

More particularly, this invention provides a playground slide construction comprising:

a hollow vertical column composed of a plurality of substantially identical hollow hub members, each member having registry means for interfitting with other such members above and below it, resilient means extending internally through the vertical column and connected in such a way that the hub members are in compression, thereby stiffening the vertical column, and a helical slideway composed of a plurality of helical slide segments encircling said vertical column, adjacent slide segments being fastened to each other, each slide segment being connected to and supported by one of the hub members.

DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Attention is first directed to FIG. 1, which illustrates a playground slide 10 which includes a hollow vertical column 12 composed of a plurality of substantially identical hollow hub members 14, with each such hub member having registry means for interfitting with other such members above and below it.

Figure 3:
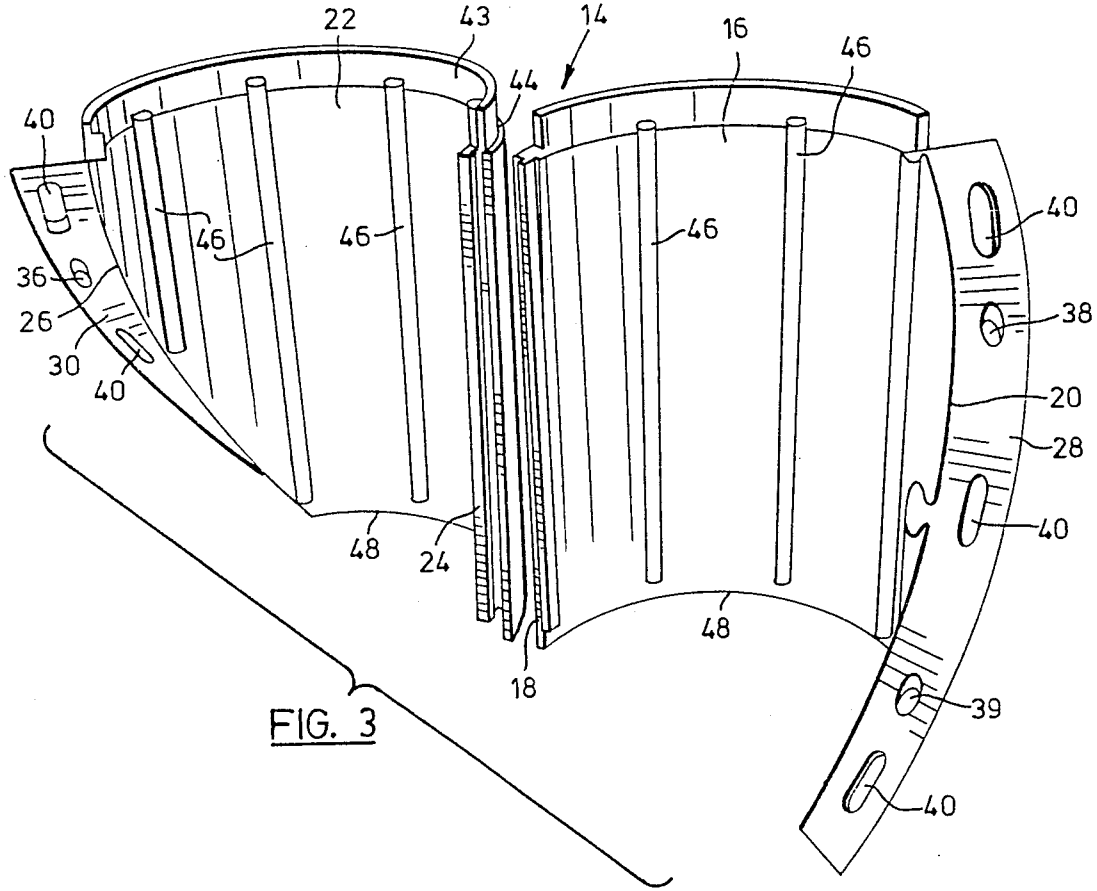
FIG. 3 is a perspective view of two complementary portions of a hub member used in the construction shown in FIG. 1.

Attention is now directed to FIG. 3, which shows the construction of a hub member 14 in greater detail. As can be seen in FIG. 3, each hub member 14 includes a first portion 16 defined between a first vertical edge 18 and a first helically extending edge 20. The hub member further includes a second portion 22 defined between a second vertical edge 24 and a second helically extending edge 26. The two helically extending edges 20 and 26 are complementary with each other such that the helically extending edges contact each other along their length when the two portions 16 and 22 are placed together to form a complete hub member. Further, the helically extending edge 20 has an integral, outwardly extending flange 28, while the helically extending edge 26 has an integral, outwardly extending flange 30. These flanges 28 and 30 are juxtaposed when the two portions 16 and 22 are placed together to form a hub member 14.

Figure 5:
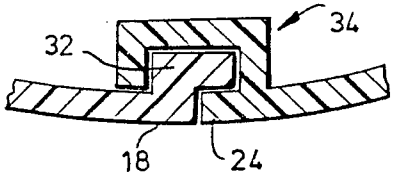
FIG. 5 is a partial cross-sectional view taken on a horizontal plane at 5—5 at FIG. 4.
Figure 4:
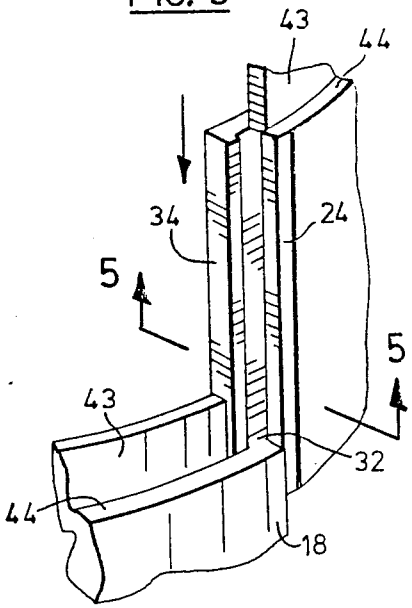
FIG. 4 is a partial perspective view, to a larger scale, of parts of the hub of FIG. 3, when partly engaged.

The first and second vertical edges 18 and 24 are configured in such a way that they interlock when the portions 16 and 22 are placed together to form a hub member 14. More particularly, and as seen in FIGS. 4 and 5, the first vertical edge 18 defines an offset portion 32 which is rectangular in cross-section, while the second vertical edge 24 includes an integral C-shaped portion 34 which defines a recess adapted to receive the portion 32. The portion 32 fits quite snugly within the recess defined by the portion 34, and it will be evident from an inspection of FIG. 5 that, once these portions are engaged as shown in that figure, they cannot be laterally separated. This means that in order to achieve the connection, the second portion 22 of the hub member 14 must first be positioned above the other portion 16 so that the portion 32 (FIG. 5) can be slid lengthwise down along the portion 34. To separate the portions 16 and 22, lengthwise movement must again be resorted to.

It should be noted that the connection shown in FIGS. 4 and 5 represents one possible way of manufacturing the hub member 14. Alternative constructions would include an integral hinge, such as a "leaving hinge", or even no hinge at all. In the latter case, the hub ember could be injection molded with a penannular cross-section, requiring some bending or distortion to achieve a complete cylindrical configuration.

Looking at FIG. 3, there is illustrated a peg 36 which is integral with the flange 30, and which is adapted to be received in an opening 38 in the flange 28. The flange 28 has a further opening 39 adapted to receive another peg similar to that shown at 36, however, the other peg is hidden from view in FIG. 3, being further down along the flange 30, and thus out of sight.

The two flanges 28 and 30 also have additional slots 40, these being in alignment when the two portions 16 and 22 are assembled together to form a hub member 14. The slots 40 provide locations through which fastening members can pass to secure the portions 16 and 22 together, and also to attach the segments of the helical slide itself.

In order to allow the hub members 14 to interfit with other such members above and below, each hub member 14 has a registry means, which can be seen in FIG. 3 and 4 to include, on the upper end of the hub member 14, an inwardly stepped collar 43 which has an external radius slightly smaller than the internal radius of the remainder of the hub member 14. The collar, due to its inward step, defines a shoulder 44 best seen in FIG. 4. When the collar 43 of one hub member 14 is inserted into the bottom or non-collar end of another hub member 14, the shoulder 44 of the inserted hub member abuts against the non-collar end of the other hub member.

FIG. 3 shows that the two portions 16 and 22 of the hub member 14 include a plurality of vertically extending strengthening ribs 46 located at spaced locations around the inside. It will also be seen in FIG. 3 that the vertical ribs 46 terminate short of the bottom edge 48 of the portions 16 and 22, in order not to interfere with the insertion of the collar 43 of the next lower hub member 14.

Figure 1:
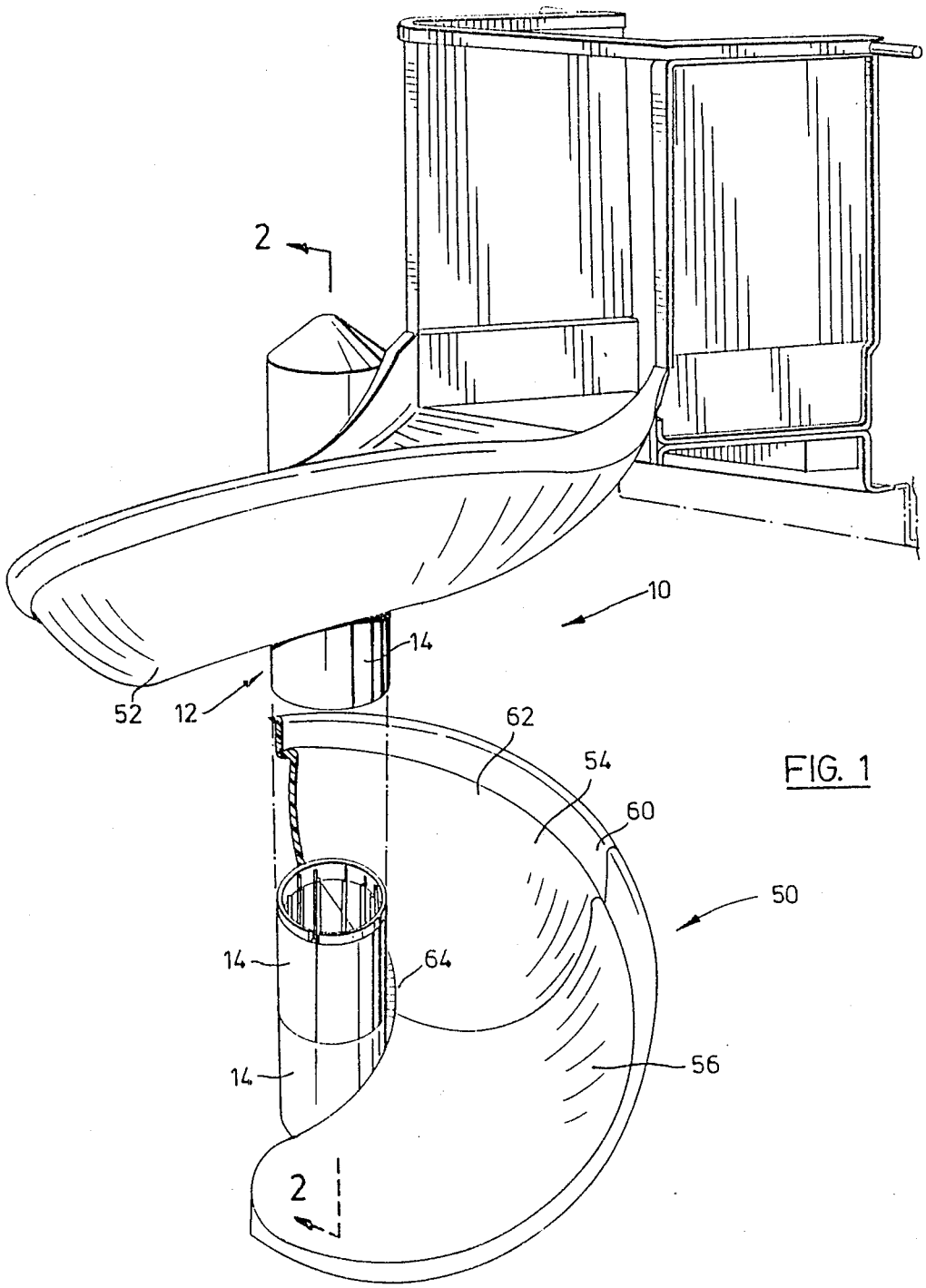
FIG. 1 is a partly broken-away perspective view of a helical slide constructed in accordance with this invention.
Figure 2:
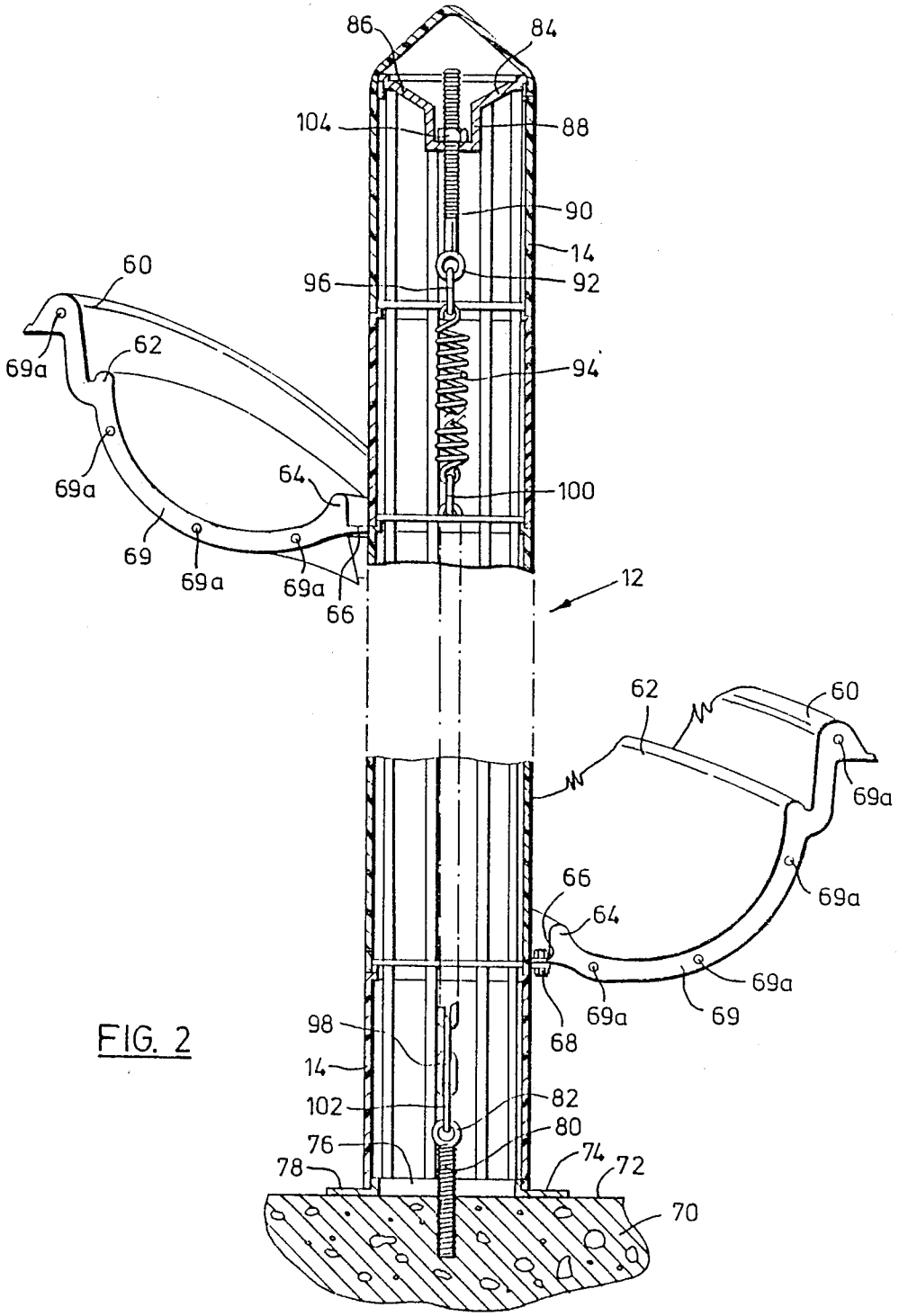
FIG. 2 is a partial vertical sectional view through the slide of FIG. 1.

Attention is now directed to FIG. 1 which shows a helical slideway 50 encircling the vertical column 12 of hub members 14. The helical slideway 50 is seen to be composed of a plurality of helical slide segments, those visible being numbered 52, 54 and 56. The segments 52 and 56 are at the top and bottom, respectively, of the slideway 50, and it will be understood that these have a different configuration from the remainder of the segments. The intermediate segments, however, are all identical. With reference simultaneously to FIGS. 1 and 2, the intermediate helical slide segments (54) are configured in such a way as to define an integral outer guard rail 60, an integral left hand internal handrail 62, and an integral right hand internal handrail 64. Each helical slide segment also has an inner flange 66 which follows the same path as the flanges 28 and 30 of the hub member 14, so that the flanges 66 of the individual helical slide segments can be fastened to the combined flanges 28 and 30 of the different hub members 14, using fasteners 68 (FIG. 2) passing through suitable openings in the flanges 66 of the helical slide segments, and also passing through the slots 40 in the flanges 28 and 30 (FIG. 3).

Each of the intermediate segments has two flanges 69 by which it is connected to the adjacent segments. This connection takes place through openings 69*a*, using conventional fasteners such as nuts and bolts. Two such flanges 69 are visible in FIG. 2.

It will be understood that the flange connection described in the preceding paragraph could be replaced with a snap-together joint. Such joints are well known.

Also in FIG. 2, it can be seen that the hollow vertical column 12 rests on a solid base member 70, typically made of concrete. The base member 70 has an upper surface 72 to which is securely affixed a locating means 74 for positively locating the lower end of the hollow vertical column 12, i.e. the bottom of the lowermost hub member 14 of the column. More specifically, the locating means 74 is an integral member incorporating an upstanding collar 76 and a horizontally extending flange 78 which may be secured to the base member 70 in any suitable manner.

An eyebolt 80 is securely fixed in the base member 70, and has a ring portion 82. The eyebolt 80 is located centrally with respect to the locating means 74.

At the upper end of the hollow vertical column 12, located inside the topmost hub member 14 is an attachment member 84 shaped somewhat as a funnel, having an outer conical portion 86 terminating at a periphery which engages the top of the inset collar 43 of the topmost hub member 14. The attachment member 84 also defines a central pocket 88 with a central opening through which an adjustable eyebolt 90 extends, with its ring portion 92 downwardly. As seen in the specific embodiment shown in FIG. 2, a helical extension spring 94 is connected by a link 96 to the ring portion 92 of the eyebolt 90, and is also connected to the upper end of a chain 98 by a further link 100. The bottom end of the chain 98 is secured by a link 102 to the ring portion 82 of the eyebolt 80.

The upper eyebolt 90 engages a nut 104 which can be turned in order to increase or decrease the tension of the spring 94.

It has been found that a tensional force of about 1500 lbs., exerted between the eyebolts 80 and 90, is sufficient to keep the hollow vertical column 12 stiff, strong, and able to withstand most of the stresses arising from normal use.

The portions 16 and 22 of the hub members may be injection molded using polyethylene structural foam, while the helical slide segments may be either vacuum formed from suitable plastic sheet material or injection molded.

It will be appreciated that this invention allows a slide construction which does not require a central pipe or shaft. Furthermore, the portions 16 and 22 of the various hub members 14 nest efficiently together, as do the helical slide segments. When packaging the slides for shipment in containers, it is expected that a space saving of approximately 33% will be realized, by comparison with current constructions of spiral slides. Because container space is normally paid for on a volume basis, it will be appreciated that substantial savings can be effected by using the construction described above.

While one embodiment of this invention has been illustrated in the accompanying drawings and described hereinabove, it will be evident to those skilled in the art that changes and modifications may be made therein, without departing from the essence of this invention, as set forth in the appended claims.

The embodiment of the Invention in which an exclusive property or privilege is claimed are defined as follows:

1. A playground slide construction comprising:

a hollow vertical column composed of a plurality of substantially identical hollow hub members, each member having registry means for interfitting with other such members above and below it, resilient means extending internally through the vertical column and said resilient means includes a length of chain and an extension coil spring, connected in such a way that the hub members are in compression, thereby stiffening the vertical column, and a helical slideway composed of a plurality of helical slide segments encircling said vertical column, adjacent slide segments being fastened to each other, each slide segment being connected to and supported by one of the hub members.

2. The slide construction claimed in claim 1, in which said registry means includes, on one end of each said hub member, an inwardly stepped collar defining a shoulder, whereby the collar of one hub member is insertable into a non-collar end of another hub member, with the shoulder of said one hub member abutting said non-collar end.

3. The slide construction claimed in claim 1, in which each said hub member comprises a first portion defined between a first vertical edge and a first helically extending edge, and a second portion defined between a second vertical edge and a second helically extending edge, the two helically extending edges being complementary and each having an outwardly projecting flange, the two flanges being juxtaposed when the two portions are placed together to form a hub member, said first and second vertical edges being configured such that they interlock when the portions are placed together to form a hub member.

4. The slide construction claimed in claim 1, further comprising a solid base member on which the hollow vertical column rests, the base member having means for positively locating the lower end of the column, and in which the resilient means further includes an attachment member inside and engaging the top of the uppermost hub member, eyelet means fixed to the base member inside the lowermost hub member, and between the attachment member and the eyelet member said extension coil spring and said length of chain are disposed.

5. The slide construction claimed in claim 4, in which each said hub member comprises a first portion defined between a first vertical edge and a first helically extending edge, and a second portion defined between a second vertical edge and a second helically extending edge, the two helically extending edges being complementary and each having an outwardly projecting flange, the two flanges being juxtaposed when the two portions are placed together to form a hub member, said first and second vertical edges being configured such that they interlock when the portions are placed together to form a hub member.

6. The slide construction claimed in claim 5, further comprising a solid base member on which the hollow vertical column rests, the base member having means for positively locating the lower end of the column, and in which the resilient means further includes an attachment member inside and engaging the top of the uppermost hub member, eyelet means fixed to the base member inside the lowermost hub member, and between the attachment member and the eyelet member said extension coil spring and said length of chain and disposed.

7. The slide construction claimed in claim 1, in which the helical slide segments are configured to define an integral right hand inner handrail and an integral left hand internal handrail, the two handrails being spaced apart to allow a user to steady himself while sliding down between them.

8. The slide construction claimed in claim 1, in which the hub members are injection molded, and include vertically extending strengthening ribs at spaced locations around the inside thereof.

9. The slide construction claimed in claim 1, in which the helical slide segments are vacuum formed.

* * * * *